United States Patent [19]

Sano

[11] 4,388,674

[45] Jun. 14, 1983

[54] PORTABLE ELECTRIC FLASHLIGHT

[75] Inventor: Tadao Sano, Fukuoka, Japan

[73] Assignee: Kyushu Hitachi Maxell, Ltd., Fukuoka, Japan

[21] Appl. No.: 249,736

[22] Filed: Mar. 31, 1981

[30] Foreign Application Priority Data

Apr. 1, 1980 [JP] Japan ..... 55-45261[U]

[51] Int. Cl.[3] ..... F21L 7/00

[52] U.S. Cl. ..... 362/186; 362/187; 362/363; 362/376; 362/399

[58] Field of Search ..... 362/186, 187, 363, 376, 362/399

[56] References Cited

U.S. PATENT DOCUMENTS 4,257,085 3/1981 Kimmel ..... 362/186

*Primary Examiner*—Stephen J. Lechert, Jr.

*Attorney, Agent, or Firm*—Antonelli, Terry & Wands

[57] ABSTRACT

An improved portable electric flashlight capable of changing over state of light projections continuously between a forward projection and a diffused peripheral projection, which is simple in construction and stable in functioning, and is also applicable to a variety of end uses, for example, as a normal flashlight to be carried about with hands, a lantern to be placed on desks or floors or hung from ceilings, etc.

14 Claims, 13 Drawing Figures

PORTABLE ELECTRIC FLASHLIGHT

Figure 1:
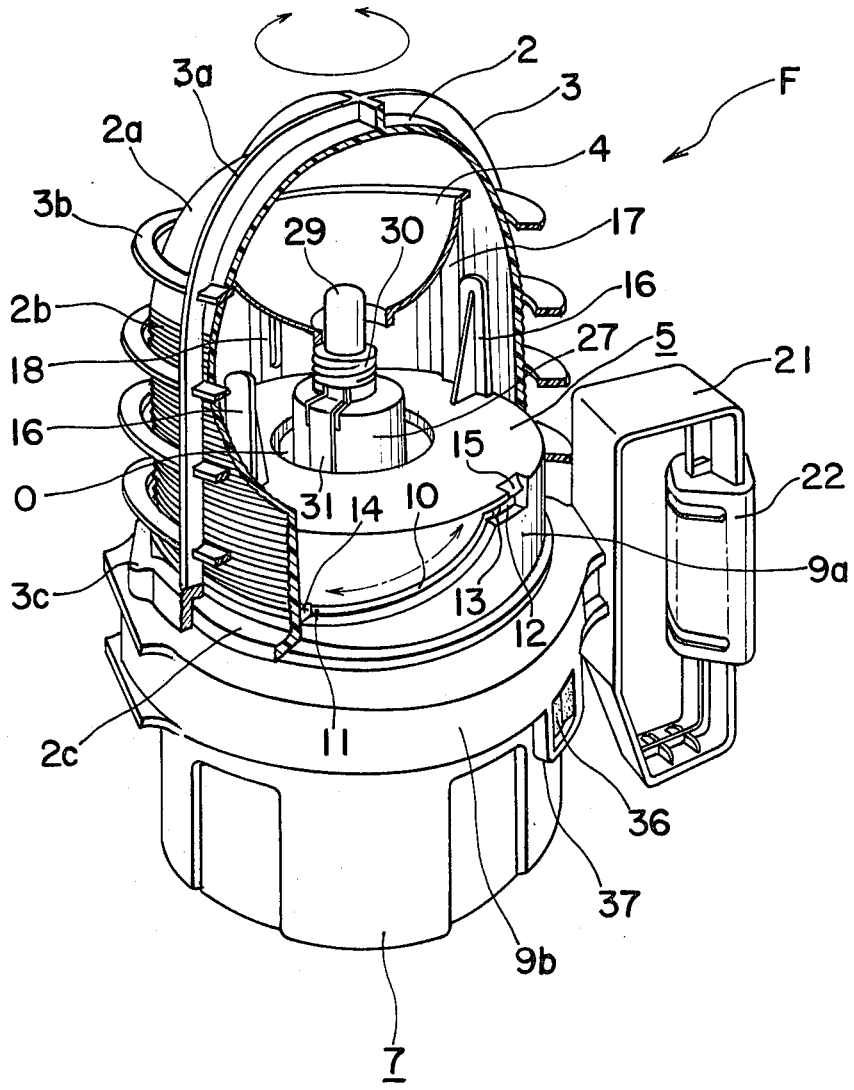

The present invention generally relates to an electric flashlight and, more particularly, to a portable electric flashlight for illumination, which is capable of changing over state of light projections between a forward light projection directed straight forward and a diffused peripheral light projection intended to illuminate a considerably large area around the flashlight.

Commonly, flashlights, for example, compact battery-operated portable electric flashlights are widely employed as a necessity in daily life as well as in various fields of industry, and depending on requirements, some types of such flashlights are arranged not only to be carried about with hands as normal flashlights, placed on desks or floors or hung from ceilings, etc. as the so-called lanterns, but also to be capable of altering state of light projections between the powerful forward light projection and the projection of diffused light in the surrounding areas.

However, known flashlights of the above described type, particularly those arranged to change-over the state of light projections, tend to be complicated in construction and large in size, and are not suitable for mass-production, with consequent high cost.

Accordingly, an essential object of the present invention is to provide an improved portable electric flashlight capable of changing over state of light projections continuously between a forward light projection and a diffused peripheral light projection, which is simple in construction and stable in functioning, and can be manufactured on a large scale at low cost.

Another object of the present invention is to provide an improved portable electric flashlight of the above described type which is applicable to a variety of end uses, for example, as a normal flashlight to be carried about with hands, a lantern to be placed on desks, floors or hung from ceilings, etc.

In accomplishing these and other objects according to one preferred embodiment of the present invention, there is provided a portable electric flashlight which includes a battery case open at its one side face for accommodating electric batteries therein, with a hood receiving member being releasably mounted on the battery case for covering the open side face of the battery case. A battery depressing plate, having an electric bulb to be illuminated by the batteries, is accommodated in the battery case, with electrically conductive pieces being provided for electrically connecting the batteries and the electric bulb. The battery depressing plate is held in position between the battery case and the hood receiving member, with a light transmitting hood member having a reflecting mirror fixedly provided at its inner forward portion for simultaneous movement with said hood member. A diffused light transmitting portion is provided at a predetermined portion around a peripheral surface of the light transmitting hood number, with the light transmitting hood member being movably mounted for continuous vertical movement with respect to the hood receiving member.

By the arrangement of the present invention as described above, an improved portable electric flashlight capable of changing over the state of light projections continuously between the forward projection and the diffused peripheral projection has been achieved through simple construction at high reliability, with substantial elimination of disadvantages inherent in the conventional portable electric flashlights of this kind.

Figure 2:
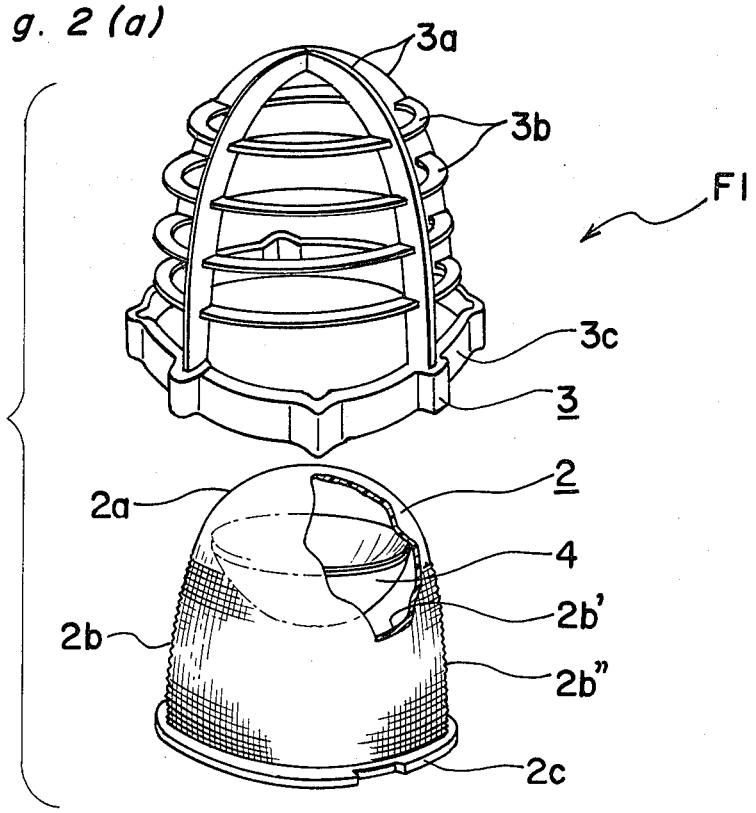
Figure 2:
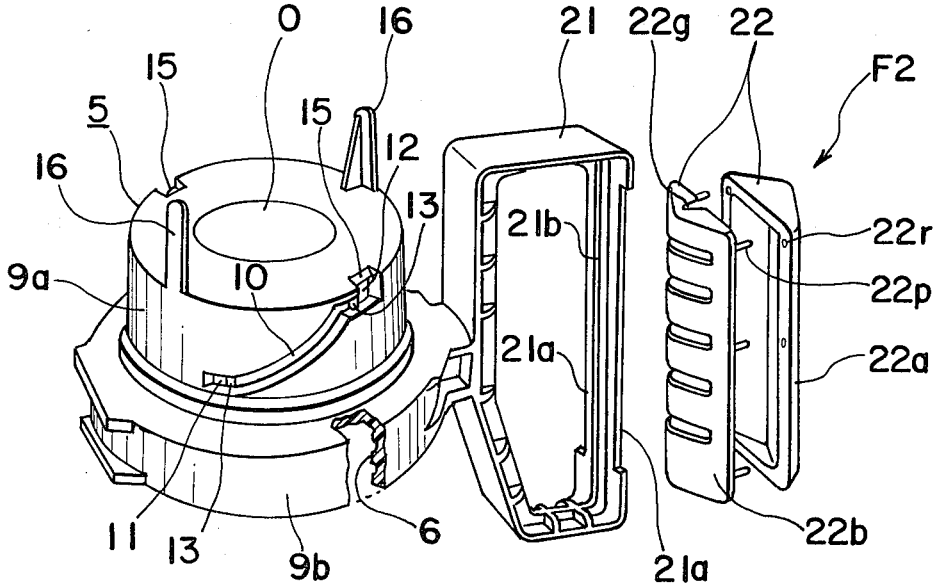
Figure 2C:
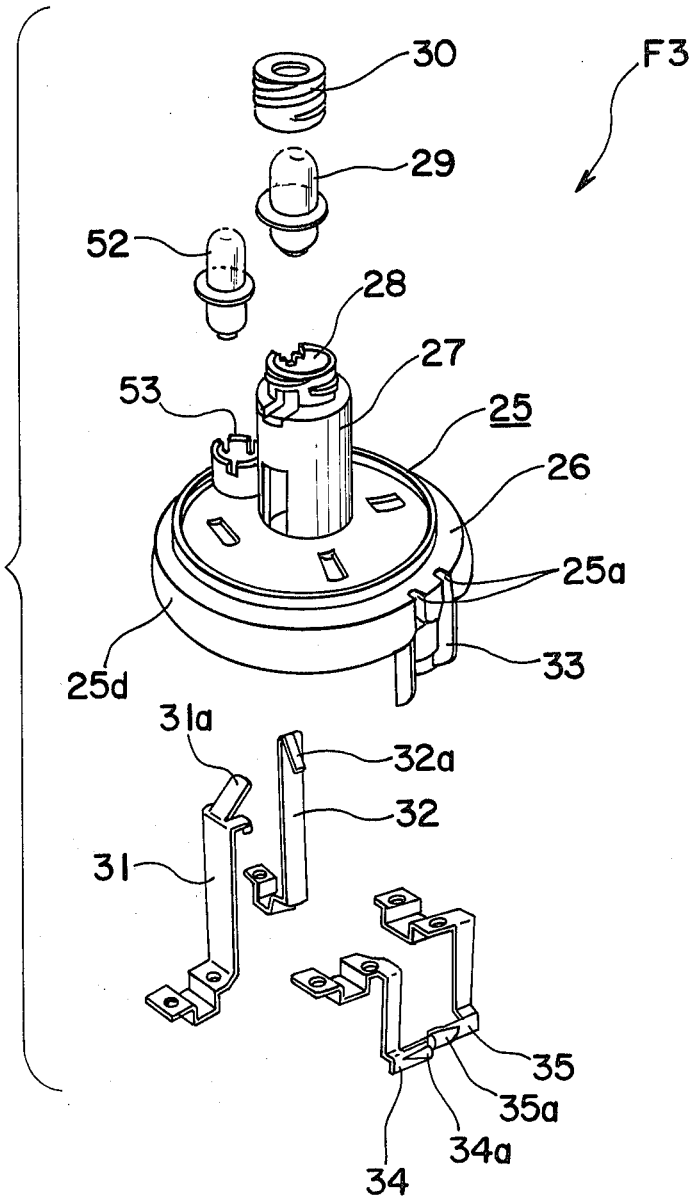
Figure 2D:
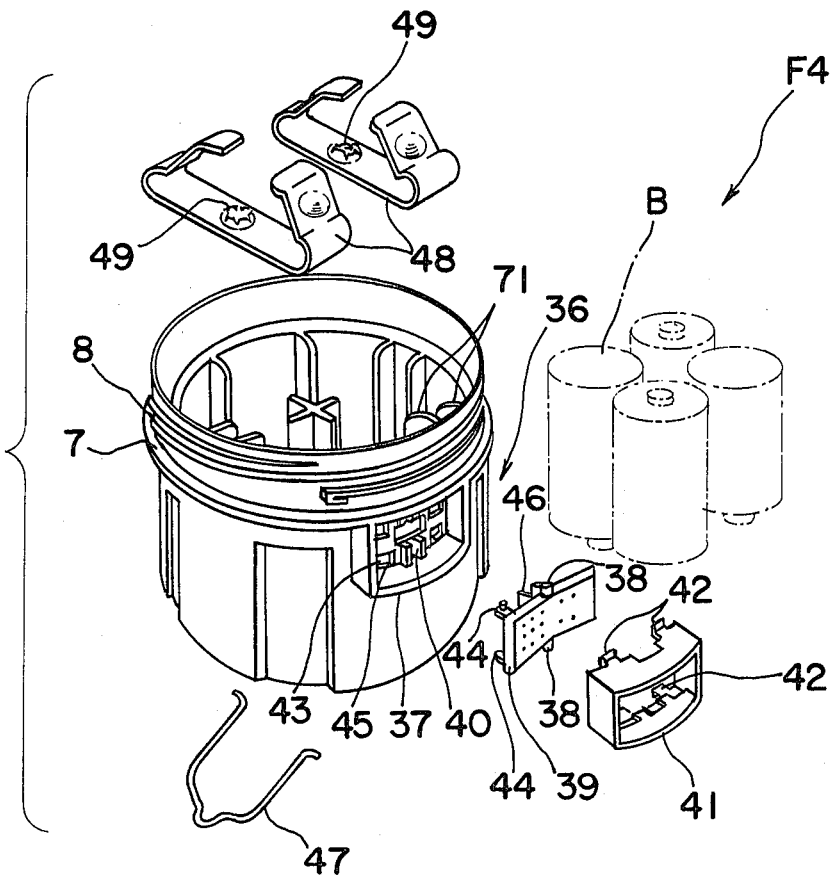
Figure 3:
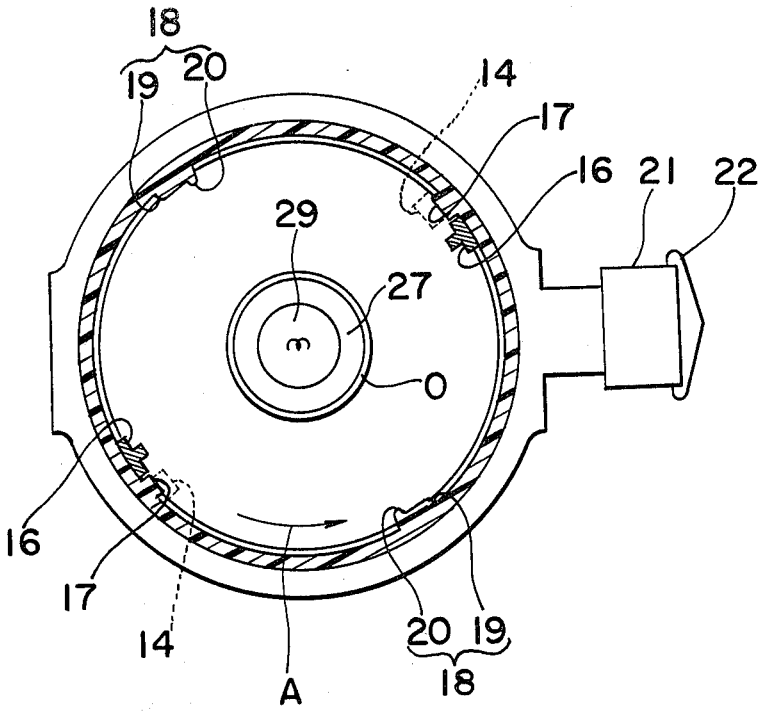
Figure 4:
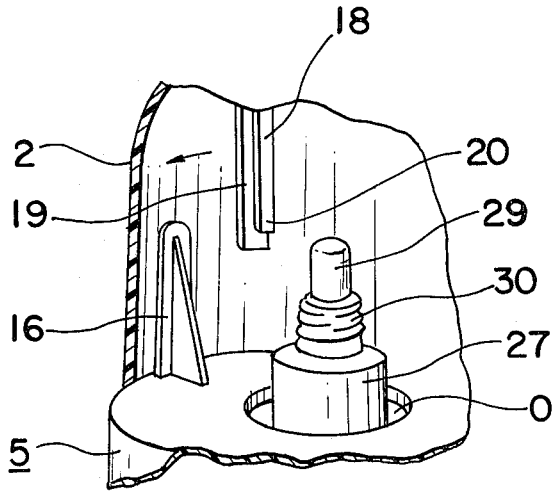
Figure 5:
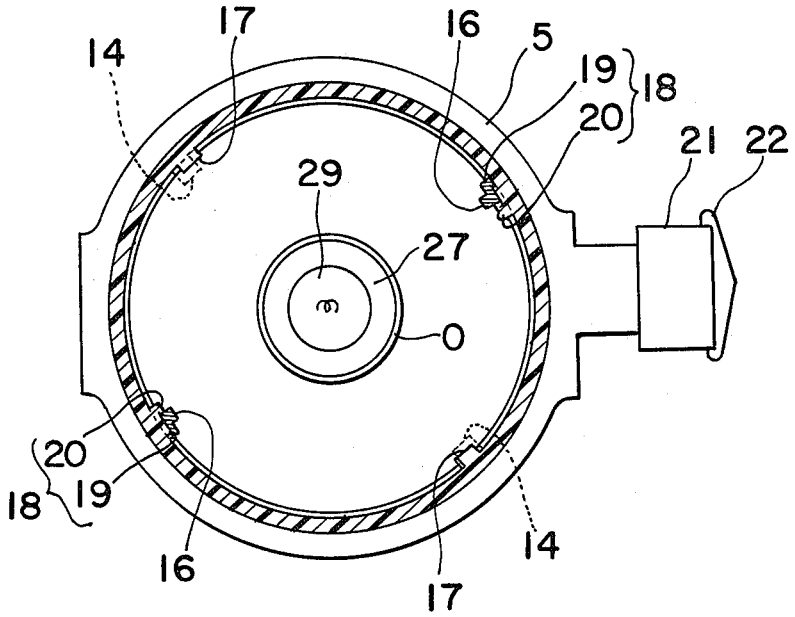
Figure 6:
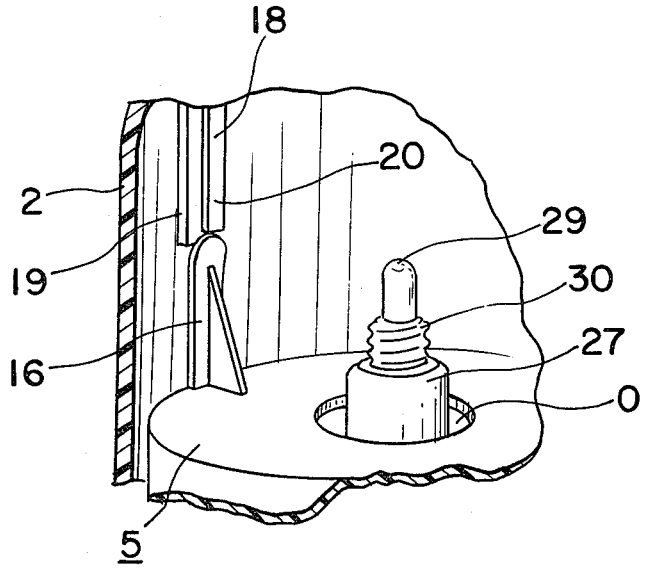
Figure 7:
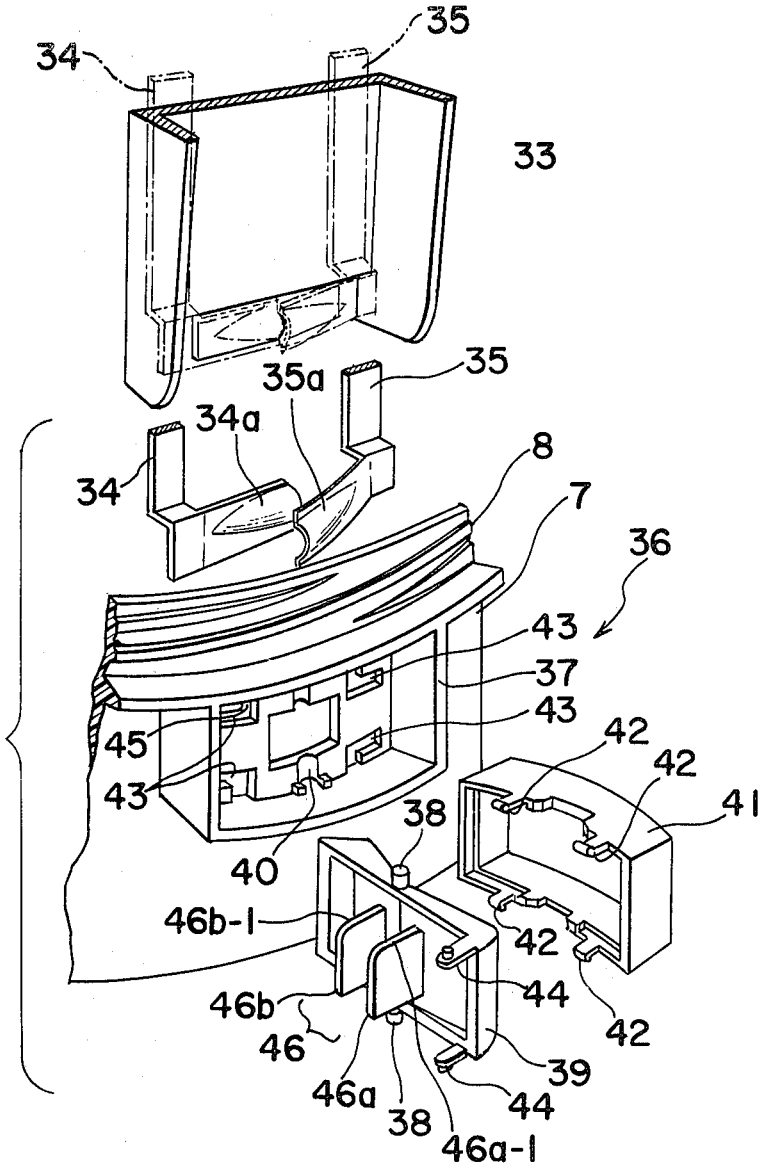
Figure 8:
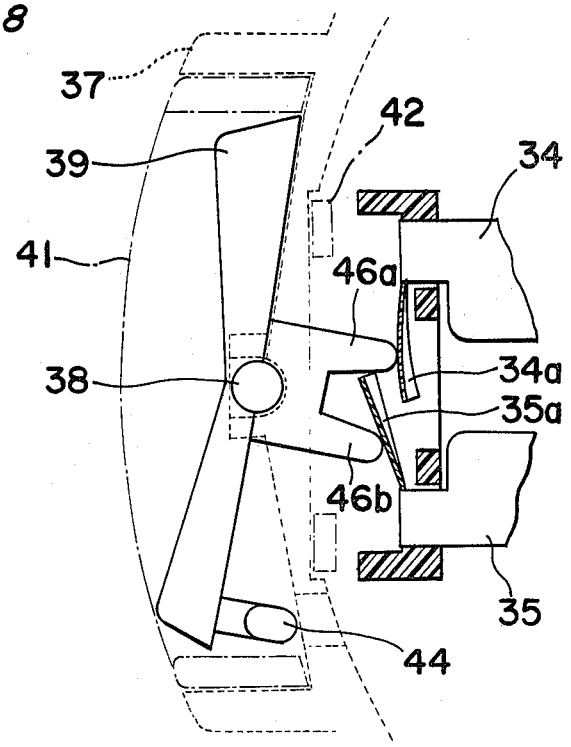
Figure 9:
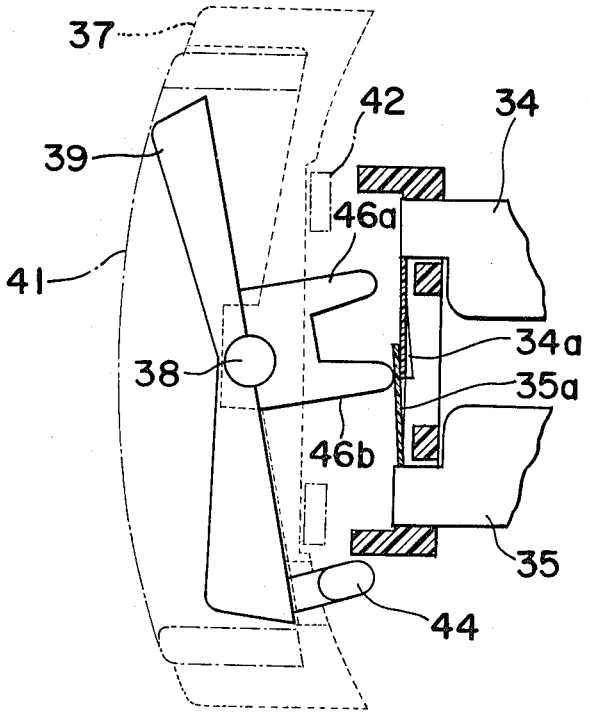
Figure 10:
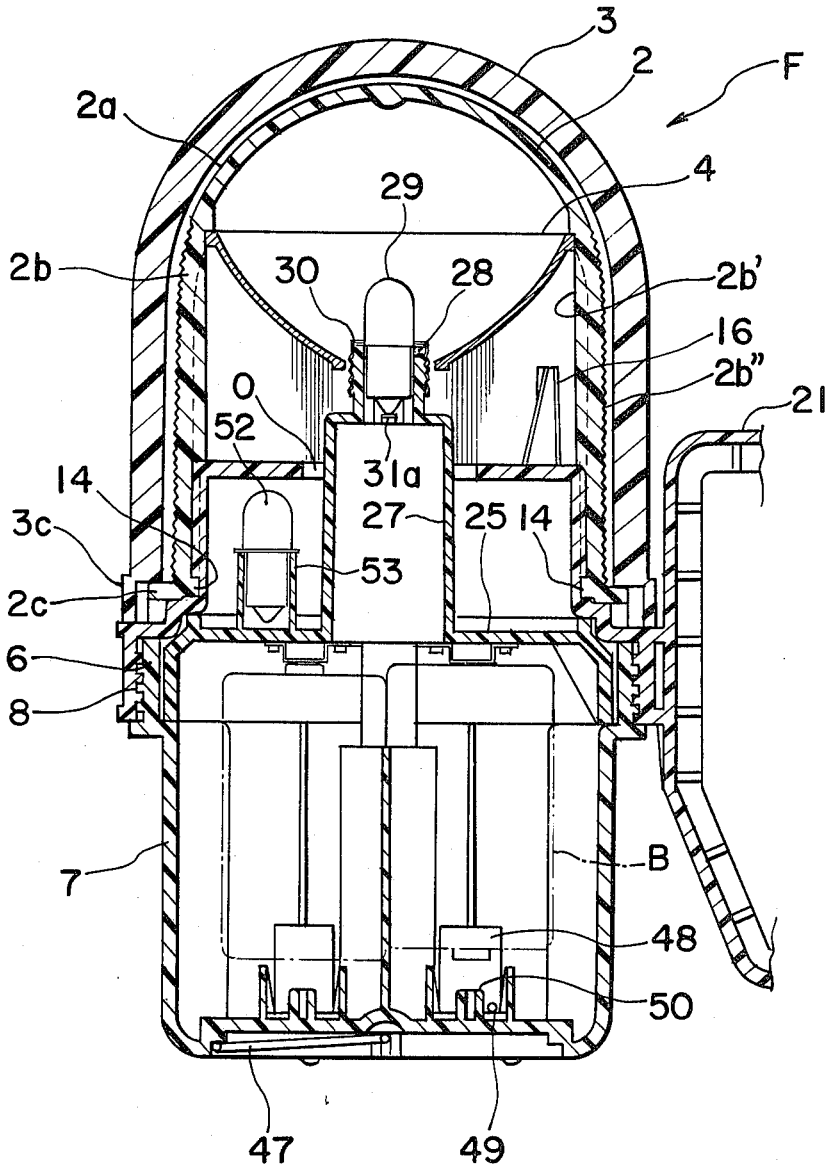

These and other objects and features of the present invention will become apparent from the following description taken in conjunction with the preferred embodiment thereof with reference to the accompanying drawings, in which;

FIG. 1 is a perspective view, partly broken away, showing the general appearance and structure of an improved portable electric flashlight according to one preferred embodiment of the present invention, FIG. 2(*a*) is an exploded view showing the construction of an illuminating section of the portable electric flashlight of FIG. 1, FIG. 2(*b*) is a view similar to FIG. 2(*a*), which particularly shows the construction of a hood receiving section thereof, FIG. 2(*c*) is a view similar to FIG. 2(*a*), which particularly shows the construction of a socket base section thereof, FIG. 2(*d*) is a view similar to FIG. 2(*a*), which particularly shows the construction of a battery container section thereof, FIG. 3 is a schematic sectional diagram of the illuminating section of the portable flashlight of FIG. 2(*a*) showing a transparent hood thereof in the lowered position, FIG. 4 is a fragmentary perspective view explanatory of the state of function during a raising of the transparent hood, FIG. 5 is a diagram similar to FIG. 3, which particularly shows the transparent hood thereof in the raised position, FIG. 6 is a view similar to FIG. 4, which is particularly explanatory of the state of function during a raising of the transparent hood, FIG. 7 is a fragmentary exploded view showing, on an enlarged scale, the construction of a switching portion employed in the arrangement of FIG. 1, and the relation thereof with respect to a side receiving piece of a battery depressing plate of the socket base section in FIG. 2(*c*), FIG. 8 is a schematic diagram of the switching portion of FIG. 7 showing the switching member in OFF position, FIG. 9 is a diagram similar to FIG. 8, which particularly shows the switching member in ON position, and FIG. 10 is a longitudinal sectional view, partly broken away, of the portable electric flashlight of FIG. 1.

Before the description of the present invention proceeds, it is to be noted that like parts are designated by like reference numerals throughout several views of the accompanying drawings.

Referring now to the drawings, there is shown, in FIGS. 1 and 2(*a*) through 2(*d*), a portable electric flashlight generally designated by the reference numeral F according to one preferred embodiment of the present invention. The portable electric flashlight F generally includes an illuminating section generally designated by the reference numeral F1, a hood receiving section generally designated by the reference numeral F2, a socket base section generally designated by the reference numeral F3, and a battery container section generally designated by the reference numeral F4 which are combined with each other in a manner as described hereinbelow.

Referring particularly to FIG. 2(*e*), the illuminating section F1 further includes a transparent hood or lens 2 and a guard or protective covering 3 applied onto the hood 2 in a spaced relation from the latter. The transparent hood 2, having a configuration as in a tip of a shell and made of transparent material, for example, acrylstyrol resin, polycarbonate resin or the like, has a front light transmitting portion 2*a* at its upper or rounded end portion, and a diffusion light transmitting portion 2*b* formed at its lower peripheral surface, with a reflecting mirror or reflector 4 being fixedly disposed at the boundary between the first light transmitting portion 2*a* and diffusion light transmitting portion 2*b* for simultaneous movement with the hood 2 so that a large diameter side of the reflector 4 is directed towards the front light transmitting portion 2*a* of the hood 2. The diffusion light transmitting portion 2*b* is formed, on its inner surface, with a number of triangular projections 2*b'* directed in the vertical direction and, on its outer surface, with triangular projection 2*b''* directed in the lateral direction so as to present a prism-like appearance as shown in FIG. 2 when observed from the outside of the hood 2.

Meanwhile, the guard 3, for example, of plastic material, is made of a plurality of spaced annular lateral beams 3*b* which are secured to or integrally formed with a number of vertical beams 3*a* each provided to conform with the outer periphery of the hood 2 in a spaced relation therefrom, while the lower ends of the vertical beams 3*a* are integrally connected to a lower base 3*c* of the guard 3, with said lower base 3*c* being fixed to a lower flange portion 2*c* of the hood 2, for example, by ultrasonic bonding.

In FIG. 2(*b*), the hood receiving section F2 includes a cylindrical hood receiving member 5, a hanger or grip portion 21 rigidly connected to or integrally formed with the peripheral edge of the hood receiving member 5, and a grip 22 fixedly mounted on said grip portion 21 in a manner as described in detail hereinbelow. The cyclindrical hood receiving member 5, made, for example, of ABS resin, further has an upper portion 9*a* of a small diameter formed with a central through-opening O, and a lower base portion 9*b* of a large diameter formed with internal threads 6 for being threadably detachable to external threads 8 formed in the upper peripheral edge of a battery case 7 for the battery container section F4 to be described later. In the peripheral wall of the upper portion 9*a*, inclined guide grooves 10 are symmetrically formed at two confronting positions as shown, with lower and upper positioning portions 11 and 12 extending in the horizontal direction at opposite end portions of each of the grooves 10. Dent ribs 13 are further provided at junctions between the guide grooves 10 and the positioning portions 11 and 12. For engagement with the guide grooves 10 and positioning portions 11 and 12, corresponding pins 14 (FIGS. 3 and 5) are provided on the lower inner portion of the hood 2 so as to be projected to a predetermined extent therefrom towards the control portion of the hood 2, and, upon application of the hood 2 of the illuminating section F1 onto the hood receiving portion 5, the pins 14 are fitted thereon, while being guided by tapered notches 15 formed in the peripheral edge of the cylindrical portion 9*a* in positions above the positioning portions 12. Since the lower portions of the notches 15 lead to the recessed portions of the positioning portions 12, the pins 14 are not readily disengaged therefrom and thus, held in position. In the above state, upon turning of the illuminating section F1, the pins 14 ride over the dent ribs 13 to engage the lower side positioning portions 11 through the inclined guide grooves 10 so as to be held in position thereat. In the manner as described above, the illuminating section F1 is vertically and continuously moved, upon rotation thereof, through the engagement of the pins 14 and guide grooves 10. For preventing excessive rotation of the illuminating section F1 in the descended or lowered state thereof, a pair of confronting stopper plates 16 (FIGS. 1 and 2(*b*)) extending upwardly from the peripheral edge of the upper portion 9*a* of the hood receiving portion 5 are arranged to be brought into contact with corresponding ribs or projections 17 (FIG. 3) provided in the inner surface of the hood 2 so that the pins 14 may not undesirably go out of the lower positioning portions 11. The stopper plates 16 are provided in positions intersecting approximately at right angles with the positions of the guide grooves 10. The reason for the aarrangement as described above is such that, during rotation especially at the raised position, the hood 2 positioned only by the pins 14, tends to be tilted, or swayed but such tilting is advantageously prevented by the contact of the stopper plates 16, which intersect at right angles with the pins 14, with the inner surface of the hood 2 as shown in FIG. 4.

Meanwhile, when the hood 2 is rotated in the direction indicated by the arrow A from the lowered position shown in FIG. 3 so as to be brought up to the raised position shown in FIG. 5, the stopper plates 16 resiliently come into contact with restricting ribs 18 provided in the inner surface of the hood 2 in positions intersecting at right angles with the ribs 17 described earlier. More specifically, each of the restricting ribs 18 has its front face 19 inclined in the rotational direction, and is also provided with a projecting stopped portion 20 at its rear face. Therefore, as the hood 2 is turned, the stopper plates 16 ride over the ristricting ribs 18 along the tapered front faces 19 thereof, with the upper portions of the stopper plates 16 being resiliently deformed inwardly, and subsequently, the upper faces of the stopper plates 16 come into contact with the projecting stepped portions 20 of the ribs 18 for positioning. Thus, at the raised position of the hood 2, unexpected lowering thereof due to application of downward external forces may be prevented.

With one portion on the peripheral side wall of the lower base portion 9*b* for the hood receiving portion 5, a frame-like hanger or grip portion 21 is rigidly connected or integrally formed, and on the side of the grip portion 21 remote from the base portion 96, there is mounted a grip member 22 made, for example, of neoprene rubber, soft ABS resin or the like in a manner as described hereinbelow. As is most clearly seen from FIG. 2(*b*), the grip member 22 is divided into two mating portions 22*a* and 22*b*, while at the confronting faces of the portions 22*a* and 22*b*, a plurality of projections 22*p* and corresponding recesses 22*r* are respectively provided for engagement under pressure therebetween during mounting of the grip member 22 onto the grip portion 21. Moreover, in the side wall of the grip portion 21 on which the grip member 22 is to be mounted, notched or cut-out portions 21*a* are formed adjacent to opposite side edges thereof, with a longitudinal rib 21*b* being further formed in the inner surface of said side wall, while the one mating portion 22*b* of the grip member 22 is formed, at opposite end walls thereof, with corresponding recesses 22*g* for receiving said longitudinal rib 21*b* so that the grip member 22 may not be deviated in position from the grip portion 21 even upon application of a strong gripping force.

It should be noted here that, the grip portion 21 is provided, in its position, at the side of the battery case 7 of the battery container section F4 containing batteries B therein and affecting the position of the center of gravity for the portable electric flashlight F, so that in the state where the grip portion 21 is gripped, the center of gravity of the flashlight F is located immediately therebelow.

Between the hood receiving portion 5 of the hood receiving section F2 and the battery case 7 of the battery container section F4 which are to be threaded into engagement with each other, there is fixedly held the peripheral edge 26 of a battery depressing plate 25 for the socket base section F3 shown in FIG. 2(*c*). At the central portion of the battery depressing plate 25, a cylindrical socket projection or bulb holder 27 is concentrically provided so as to be inserted into the through-opening O of the hood receiving portion 5 for the hood receiving section F2, and to extend up to the reflector 4 of the illuminating section F1 in the descended state of the hood 2. In the opening or socket 28 formed at the upper end of the bulb holder 27, an electric bulb 29 is mounted so as to be retained thereat by a metallic retainer ring 30. Meanwhile, electrically conductive strips or terminal plates 31 and 32, having corresponding folded terminal portions 31*a* and 32*a* at the upper ends thereof (FIG. 2(*c*)) are, provided to extend from the under surface of the battery depressing plate 25 into the socket 28. Resilient switching pieces 34, 35 are fitted in a side receiving piece 33 extending downwardly from the battery depressing plate 25 at a position adjacent to the inner surface of a peripheral wall 25*d* which depends from the peripheral edge of said plate 25. The switch operating portion generally designated by the reference numeral 36 (FIGS. 2(*d*) and 7), which actuates the switching pieces 34 and 35 for selective opening and closing, is incorporated at the side of the battery case 7 for the battery container section F4 in a manner to be described in detail herebelow.

Referring also to FIGS. 7 to 9, at a position immediately below the external threads 8 in the outer periphery of the battery case 7, there is formed a frame portion 37 in which a switch button 39, capable of rocking motion about its pins 38, is held in position through a cover member 41, with the pins 38 of the switch button 39 being supported by pin receiving recesses 40 formed in the frame portion 37 (FIGS. 2(*d*) and 7). The cover member 41 is attached to the frame portion 37 by resiliently engaging protrusions 42 formed at its forward edges with corresponding through-holes 43 of the frame portion 37. Additionally, the switch button 39 is provided with resilient dent protrusions 44 formed at least at one side edge thereof for articulate movement through stepped portions 45 communicated with the through-holes 43, and thus, an actuator portion 46 provided at the rear surface of the switch button 39 depresses the switch pieces 34 and 35 for bringing the switch piece 35 into contact with the switch piece 34.

The above arrangement of the switch operating portion 36 described so far is particularly characterized in that, the actuating portion 46, provided at the rear surface of the switch button 39 being capable of rocking movement, includes a pair of actuating pieces 46*a* and 46*b* spaced a predetermined distance from each other with respect to the support pins 38 for the rocking motion, while one actuating piece 46*a* corresponds to the end portion 34*a* of the resilient switching piece 34, and the other actuating piece 46*b*, to the end portion 35*a* of the switching piece 35. The end portions 34*a* and 35*a* of the resilient switching pieces 34 and 35 as described above are processed to have swelling or bulging portions for smooth engagement during assembly, with the actuating pieces 46*a* and 46*b* rounded at the upper corners 46*a*-1 and 46*b*-1 thereof, so as to improve mechanical strength at electrical contacts, and thus, the respective end portions 34*a* and 35*a* are normally urged, at the base portions thereof, outwardly or towards the sides of the actuating pieces 46*a* and 46*b*.

In FIG. 8 showing the switch button 39 in "OFF" position, the actuating piece 46*a* prevents the switching piece 34 from being raised outwardly, while the actuating piece 46*b* allows the end portion 35*a* of the switching piece 35 to rise, and thus, the respective end portions 34*a* and 35*a* do not come close to each other for electrical conduction therebetween. In the above state, when the switch button 39 is depressed for rocking motion, the state as shown in FIG. 9 is established, and although the actuating piece 46*a* moves outwardly, with the end portion 34*a* of the switching piece 34 tending to be raised, the end portion 46*b* depresses the end portion 35*a*, and consequently, the end portions 34*a* and 35*a* are brought into conduction with each other. As described above, since the respective end portions 34*a* and 35*a* are depressed at all times by either one of the actuating pieces 46*a* or 46*b* for positioning, there is no possibility that they are affected by dimensional errors during assembly or shortcircuited by an external impact force.

Furthermore, since the resilient switching pieces 34 and 35 are fixed to the side receiving piece 33 of the battery depressing plate 25 and the switch button 39 is provided at the side of the battery case 7, while guide slits 25*a* (FIG. 2(*c*)) are formed in the peripheral side wall adjacent to the side receiving piece 33, with guide ribs 71 (FIG. 2(*d*)) being provided in corresponding positions on the inner periphery of the battery case 7, there is no possibility of positional deviation even when the battery depressing plate 25 is dismounted or mounted during battery replacement, or the hood receiving portion 5 of the hood receiving section F2 is strongly threaded onto the external threads 8 of the battery case 7, and thus, proper positional relation may be maintained at all times.

As described above, owing to the arrangement wherein the electrically conductive members, for example, electrically conductive pieces 31 and 32 and resilient switching pieces 34 and 35, etc. are all mounted to the battery depressing plate 25, management of parts during assembly may be extremely simplified. Moreover, since positive functioning is achieved at the combined state even when the contact portions of the switch, i.e. the resilient switching pieces 34 and 35 and the switch operating portion 36 are separately provided as independent portions, no particular skill is required for the assembly of the switching arrangement, especially of the switch operating portion 36.

The portable electric flashlight F further includes a lifting hook 47(FIGS. 2(*d*) and 10) made, for example, of a steel wire, the opposite ends of which are pivotally connected to the under surface of the battery case 7. To the inner bottom surface of the battery case 7, a pair of connecting conductive plates 48 are secured by fitting nut portions or so-called "Speed-Nuts" 49 formed at the central portions thereof through punching or the like, onto corresponding boss portions 50 formed on the inner bottom surface of the battery case 7 as shown in FIG. 10 illustrating the state where each parts and components have been assembled. It is to be noted here that, in FIG. 2(*c*), a spare electric bulb 52 is arranged to be held in a spare bulb holder 53 provided on the battery depressing plate 25.

In summary, the present invention is characterized in that the portable electric flashlight F includes the battery case 7 open at its one side face for accommodating electric batteries B therein, with the hood receiving member 5 being releasably mounted on the battery case 7 for covering the open side face of the battery case 7. The battery depressing plate 25 has the electric bulb 29 to be illuminated by the batteries B accommodated in the battery case 7 and electrically conductive pieces 31, 32, 33 and 34 are provided for electrically connecting the batteries B and the electric bulb 29. The battery depressing plate 25 is held in position between the battery case 7 and the hood receiving member 5. The light transmitting hood member 2, having a diffusion light transmitting portion **2*b* at a predetermined portion around peripheral surface thereof, is movably mounted for continuous vertical movement thereof, with respect to the hood receiving member 5**.

The hood receiving member 5 is provided with a grip portion 21 adapted to be gripped with a hand and for enabling a hanging of portable electric flashlight F during use. Although it is a general practice to provide a grip portion on a battery case which is heavy in weight, in a flashlight in which the hood member 2 is arranged to be raised or lowered, the operation of the flashlight is greatly facilitated by providing the grip portion at the side of the hood receiving member 5 as in the present embodiment.

The grip portion 21 is formed in a direction of the vertical movement of the light transmitting hood member 2. During raising or lowering of the hood member 2, the state of light projections is generally adjusted, with the flashlight F turned "ON". In such cases, the above arrangement is particularly effective for facilitated adjustments, since the optical axis is not swayed or deviated, owing to the vertical raising or lowering of the hood member 2 in the same direction.

The hood receiving member 5 is further provided with the grip portion 21 integrally provided so as to extend outwardly from the hood receiving member 5 with a position of junction between the hood receiving member 5 and the grip portion 21 being set on a vertical line passing through the center of gravity of the portable electric flashlight F containing the batteries B therein. By the above arrangement, the flashlight F can be maintained horizontal, when the grip portion 21 is held by a hand.

The battery depressing plate 25 having the electrically conductive pieces 31, 32, 34 and 35 to be connected with the batteries B is further provided with the peripheral wall **25*d* depending from the peripheral edge thereof for surrounding the electrically conductive pieces 31, 32, 34 and 35**.

The depending peripheral wall **25*d* serves as a guide portion to prevent side play or lateral swaying of the batteries B, and also as a protector for the electrically conductive pieces 31, 32, 34 and 35** to avoid other appliances from striking against said conductive pieces.

The hood receiving member 5 is formed into a cylindrical configuration so as to provide guide means in confronting positions on a side wall thereof, (i.e. the grooves 10) for enabling the vertical movement of the hood member 2, with stopper plate members 16 which contact the inner surface of the hood member 2 for restricting lateral swaying of the hood member 2 being provided in positions intersecting at right angles with the guide means (i.e. the grooves 10) on the upper surface of the hood receiving member 5.

The stopper plates 16 are effective for restricting the lateral swaying of the hood member 2 without reducing the sidewise diffused light projecting efficiency of the flashlight F.

The transparent hood member 2 is further provided, on its inner surface, with restricting ribs 18 which are brought into contact with free ends of the stopper plates 16 at a position where the hood member 2 has been raised. By the above arrangement, undesirable lowering of the hood member 2 due to possible application of an external force from above the hood member 2 at the raised position of said hood member 2 may be advantageously prevented.

As is clear from the foregoing description, according to the arrangement of the present invention, an improved portable flashlight, which can readily change over the state of light projections continuously between the forward light projection and diffused peripheral light projection, has been advantageously presented through simple construction, and consequently at low cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A portable electric flashlight which comprises a battery case open at one side face for accomodating at least one electric battery therein, a hood receiving member releasably mounted on the battery case for covering the open side face of said battery case, a battery depressing plate for mounting an electric bulb to be illuminated by the at least one battery accommodated in said battery case and electrically conductive means for establishing an electrical connection between the at least one battery and said electric bulb, the battery depressing plate being held in position between said battery case and said hood receiving member, and a light transmitting hood member having a front light transmitting portion and a diffused light transmitting portion at a predetermined peripheral surface portion thereof, and means for mounting the light transmitting hood member so as to enable vertical movement thereof with respect to said hood receiving member whereby light may be selectively projected through the front light transmitting portion and the diffused light transmitting portion.

2. A portable electric flashlight as claimed in claim 1, wherein said hood receiving member is provided with a grip portion to be held with a hand and for enabling a hanging of said portable electric flashlight during use thereof.

3. A portable electric flashlight as claimed in claim 2, wherein said grip portion extends in a direction of the vertical movement of said light transmitting hood member.

4. A portable electric flashlight as claimed in claim 2, wherein said grip portion is integrally formed with said hood receiving member so as to extend outwardly from said hood receiving member, and wherein a junction between said hood receiving member and said grip portion is set on a vertical line passing through a center of gravity of said portable electric flashlight containing the at least one battery therein.

5. A portable electric flashlight as claimed in claim 1, wherein said battery depressing plate includes a peripheral wall depending from a peripheral edge thereof for surrounding said electrically conductive means.

6. A portable electric flashlight as claimed in claim 1, wherein said hood receiving member is cylindrical and includes guide means arranged at confronting positions on a side wall of said hood receiving member for guiding the vertical movement of said light transmitting hood member, stopper means in contact with an inner surface of said light transmitting hood member for restricting lateral swaying of said hood member, said stopper means being provided in positions intersecting at right angles with said guide means on an upper surface of said hood receiving member.

7. A portable electric flashlight as claimed in claim 6, wherein means are provided on an inner surface of said light transmitting hood member for holding said light transmitting hood member in a raised position.

8. A portable electric flashlight which comprises a battery case open at its one side face for accommodating electric batteries therein, a hood receiving member releasably mounted on the battery caee for covering the open side face of said battery case, a battery depressing plate which has an electric blub to be illuminated by the batteries accommodated in said battery case and electrically conductive pieces for electrical connection between the batteries and said electric bulb, and which is held in position between said battery case and said hood receiving member, and a light transmitting hood member having a reflecting mirror fixedly provided at its inner forward portion for simultaneous movement with said light transmitting hood member and a diffused light transmitting portion at a predetermined peripheral portion thereof said light transmitting hood member being movably mounted for continuous vertical movement thereof, with respect to said hood receiving member.

9. A portable electric flashlight as claimed in claim 6, wherein said stopper means are formed as plate members.

10. A portable electric flashlight as claimed in claim 7, wherein said means for holding includes restricting ribs adapted to be brought into contact with free ends of the stopper means when the light transmitting hood member is in the raised position.

11. A portable electric flashlight as claimed in claim 1, wherein said electrically conductive means includes a switch means having resilient switching members mounted on the battery depressing plate and being adapted to open and close the electrical connection between the at least one battery and the electric bulb, the battery depressing plate includes an outwardly projecting side portion along a peripheral portion thereof for accommodating the resilient switching members, and wherein the electrically conductive means further includes an electrically conductive strip means interposed between said resilient switching members and the electric bulb.

12. A portable electric flashlight as claimed in claim 11, wherein the battery case includes a frame portion for accommodating said switch means, the switch means includes a switch button provided with means for selectively bringing the switching members into and out of electrical contact, and wherein means are provided on said frame portion and said switch button for enabling a mounting of said switch button for a rocking movement.

13. A portable electric flashlight as claimed in one of claims 11 or 12, wherein a grip portion is formed on said hood receiving member so as to extend outwardly therefrom, and wherein a junction between said hood receiving member and said grip portion is disposed on a vertical line passing through a center of gravity of the portable electric flashlight having the at least one battery contained therein.

14. A portable electric flashlight as claimed in claim 13, wherein means are provided on an inner surface of the light transmitting hood member for holding said light transmitting hood member in a raised position.

* * * * *